US006820759B1

(12) United States Patent
Schindler et al.

(10) Patent No.: US 6,820,759 B1
(45) Date of Patent: Nov. 23, 2004

(54) RAIL VEHICLE FOR PASSENGER TRANSPORTATION, ESPECIALLY FOR LOCAL TRAFFIC

(75) Inventors: Christian Schindler, Korschenbroich (DE); Manfred Buerger, Wuennenberg (DE); Karl-Eberhard Geyer, Duesseldorf (DE); Ryszard Zielinski, Duesseldorf (DE)

(73) Assignee: Siemens AG, Munich (DE)

( * ) Notice: Subject to any disclaimer, the term of this patent is extended or adjusted under 35 U.S.C. 154(b) by 0 days.

(21) Appl. No.: 10/130,802

(22) PCT Filed: Nov. 17, 2000

(86) PCT No.: PCT/DE00/04079

§ 371 (c)(1),
(2), (4) Date: Sep. 3, 2002

(87) PCT Pub. No.: WO01/38153

PCT Pub. Date: May 31, 2001

(30) Foreign Application Priority Data

Nov. 25, 1999 (DE) ..... 199 56 856

(51) Int. Cl.[7] ..... B65D 55/02
(52) U.S. Cl. ..... 213/221
(58) Field of Search ..... 213/1 A, 7, 8, 213/9, 220, 221, 222

(56) References Cited

U.S. PATENT DOCUMENTS

| | | | | | |
|---|---|---|---|---|---|
| 3,797,873 | A | * | 3/1974 | Cook | 293/133 |
| 5,630,605 | A | * | 5/1997 | Smallwood | 280/432 |
| 5,687,860 | A | | 11/1997 | Behrens et al. | |
| 6,435,102 | B1 | * | 8/2002 | Malkovsky | 105/413 |
| 6,561,105 | B2 | * | 5/2003 | Godin et al. | 105/396 |
| 6,685,040 | B2 | * | 2/2004 | Heinisch et al. | 213/221 |

FOREIGN PATENT DOCUMENTS

| | | |
|---|---|---|
| DE | 197 57 917 A | 7/1998 |
| EP | 0 612 647 A | 8/1994 |
| EP | 0 802 100 A | 10/1997 |
| EP | 0 952 063 A | 10/1999 |
| WO | 98/38438 | 9/1998 |

* cited by examiner

*Primary Examiner*—S. Joseph Morano
*Assistant Examiner*—Robert J. McCarry, Jr.
(74) *Attorney, Agent, or Firm*—Michael J. Striker

(57) ABSTRACT

A rail vehicle for passenger transportation, especially for local traffic, is provided with shock absorption units (1) at at least one of its ends. Said shock absorber units (1) are supported on a sandwich part (2) containing deformable metallic foam, in the longitudinal direction of the vehicle, said sandwich part forming a partial area of the floor (3) of the driver compartment (4), as a supporting structural element.

4 Claims, 7 Drawing Sheets

RAIL VEHICLE FOR PASSENGER TRANSPORTATION, ESPECIALLY FOR LOCAL TRAFFIC

BACKGROUND OF THE INVENTION

The invention concerns a rail vehicle for passenger transportation, especially for local traffic, that is provided with shock-absorbing units on at least one of its ends.

It is generally known to arrange shock-absorbing units (shock dampers) in the end region of rail vehicles that comprise, for example, elastomer bodies or deformable hollow bodies made of sheet metal. Apparatuses of this type can absorb a portion of the impact energy that occurs when the vehicle runs into vehicles of the same type, road vehicles, or a fixed obstacle.

SUMMARY OF THE INVENTION

The invention is based on the object of creating an innovative collapsible zone having a defined behavior with regard for any impacts that may occur for use in a rail vehicle of the generic type.

This object is attained according to the invention by the fact that the shock-absorbing units are supported in the longitudinal direction of the vehicle against a deformable sandwich component containing metallic foam that forms a sub-region of the floor of the driver's cabin as a load-bearing structural element.

Advantageous embodiments of the invention are indicated in the subclaims.

The invention will be described in greater detail below using exemplary embodiments that are shown in the drawing.

BRIEF DESCRIPTION OF THE DRAWINGS

In contrast to FIGS. 1 and 2 the rail vehicle shown in FIGS. 3 and 4—in a perspective view as well—has a central buffer coupling 8 made known in DE 195 13 386 A1, the linkage of which comprises elements 8*a* that cooperate in a scissors-like fashion

DETAILED DESCRIPTION OF THE PREFERRED EMBODIMENTS

Figure 1:
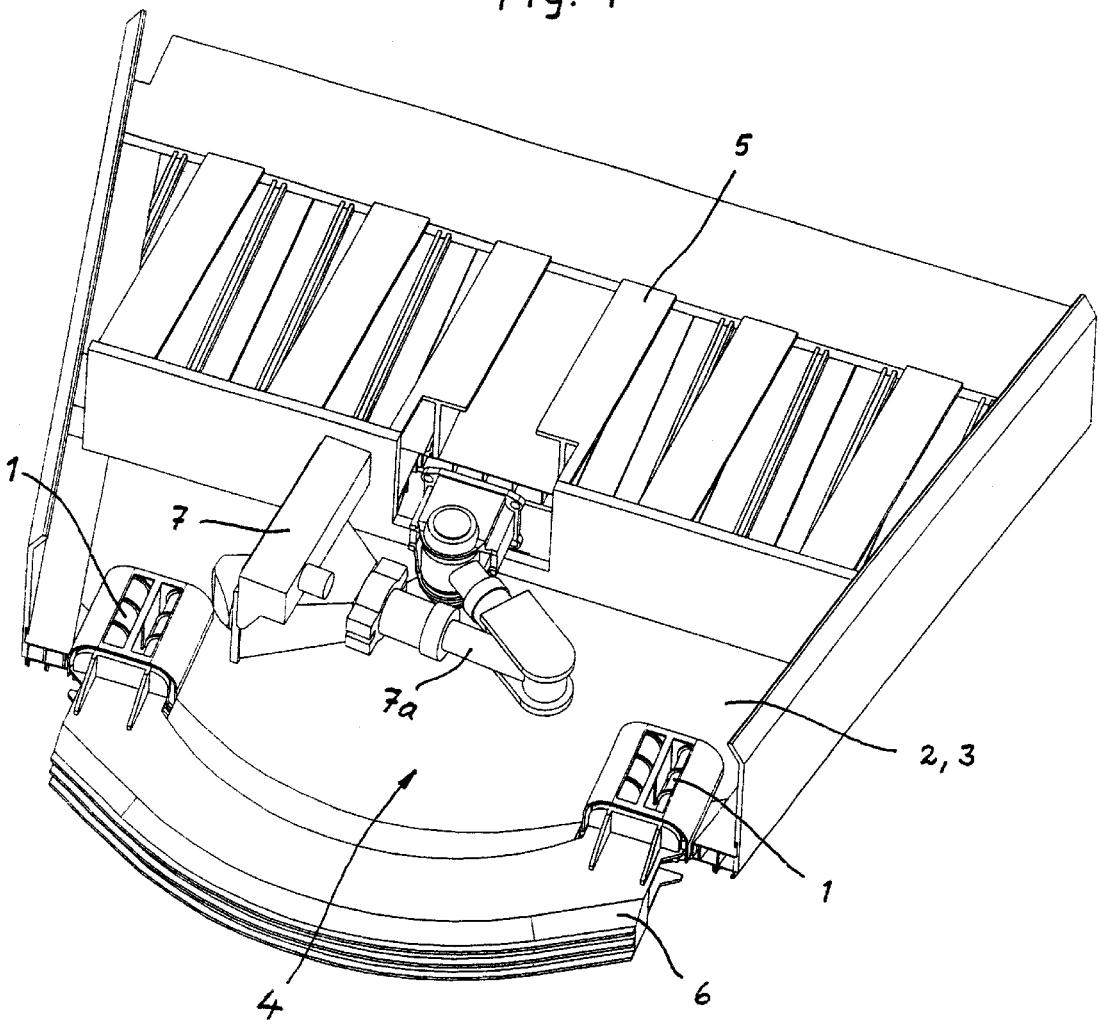
FIGS. 1 and 2 each show a perspective view of the lower region of the front section of a rail vehicle that comprises a central buffer coupling 7 having a hingedly-designed coupling arm 7*a*.
Figure 2:
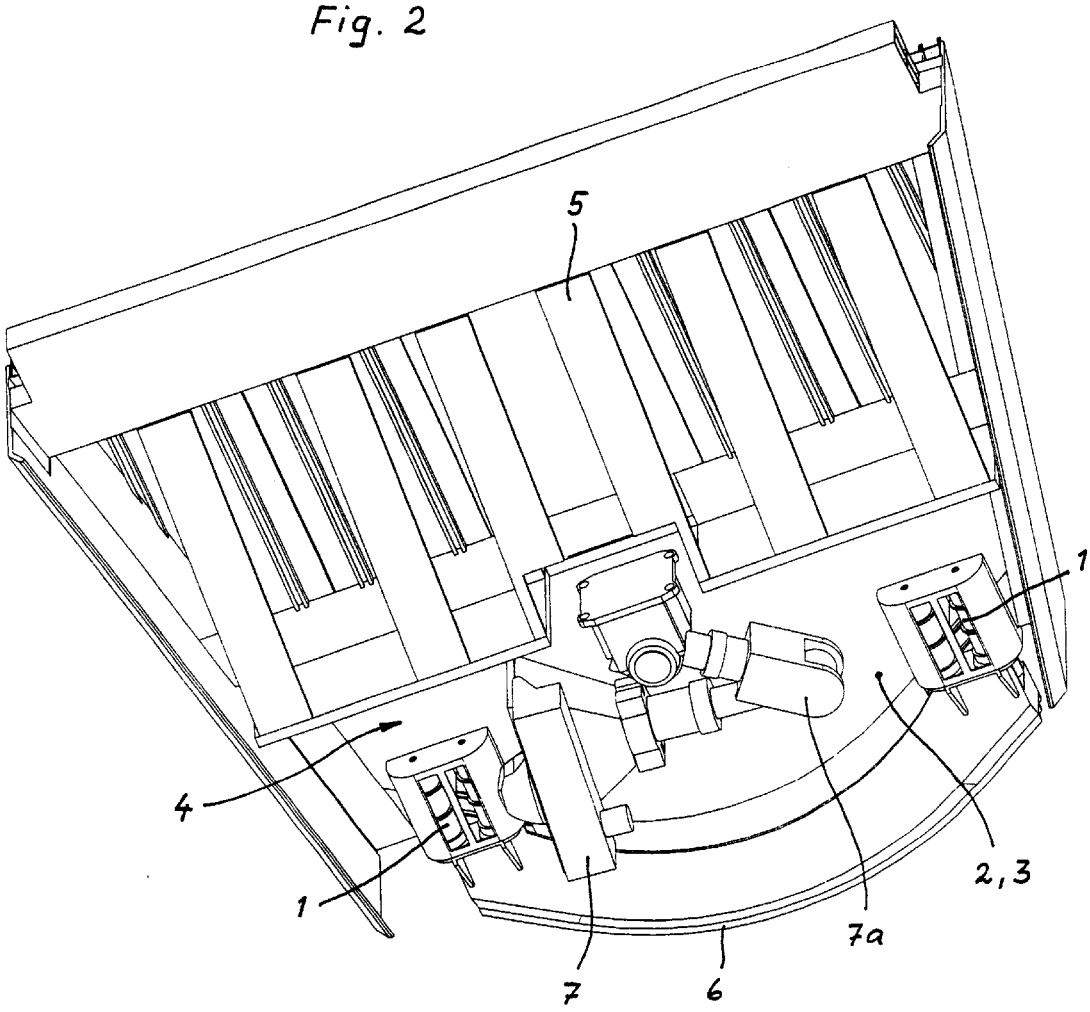
Figure 3:
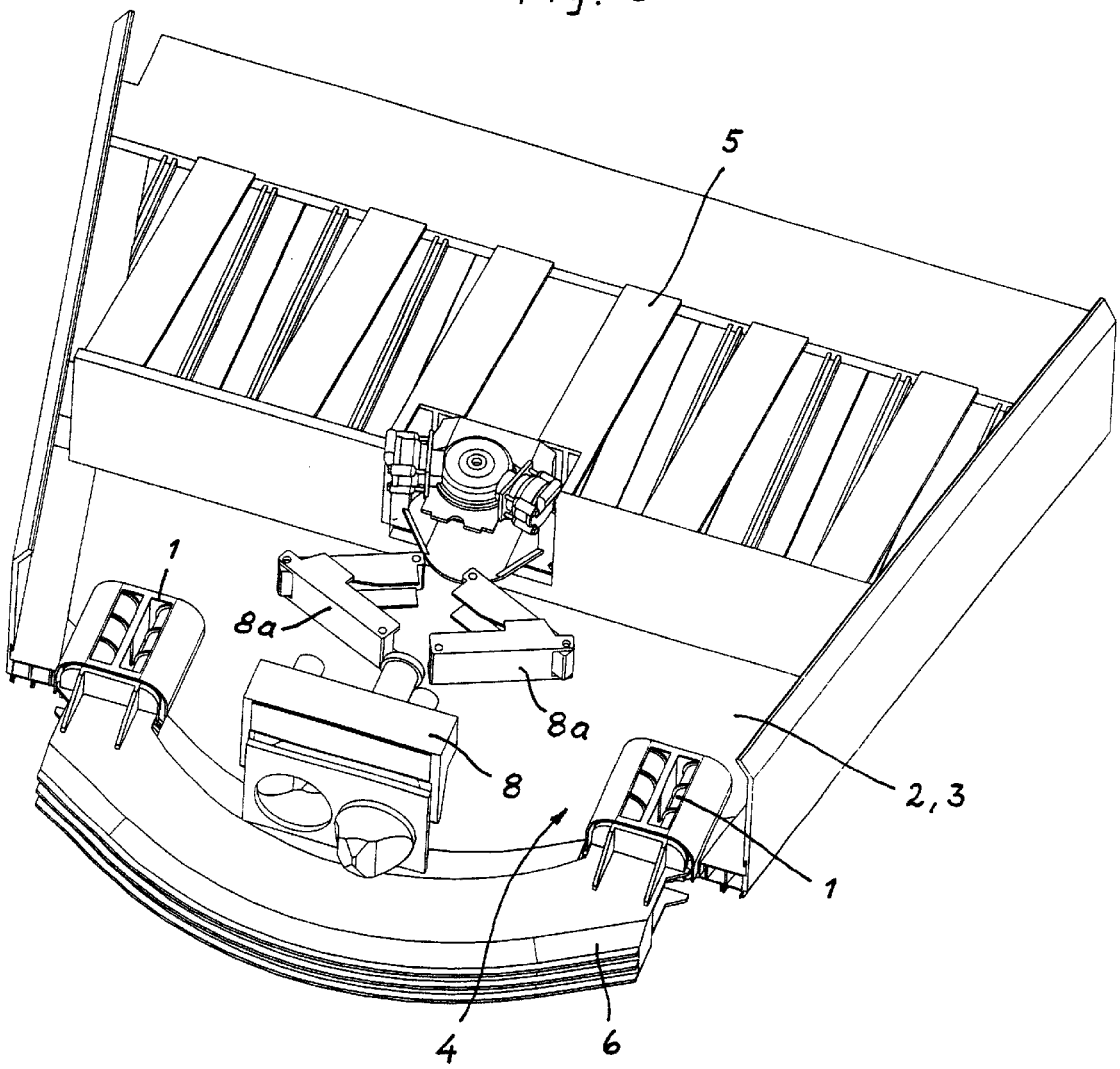
Figure 4:
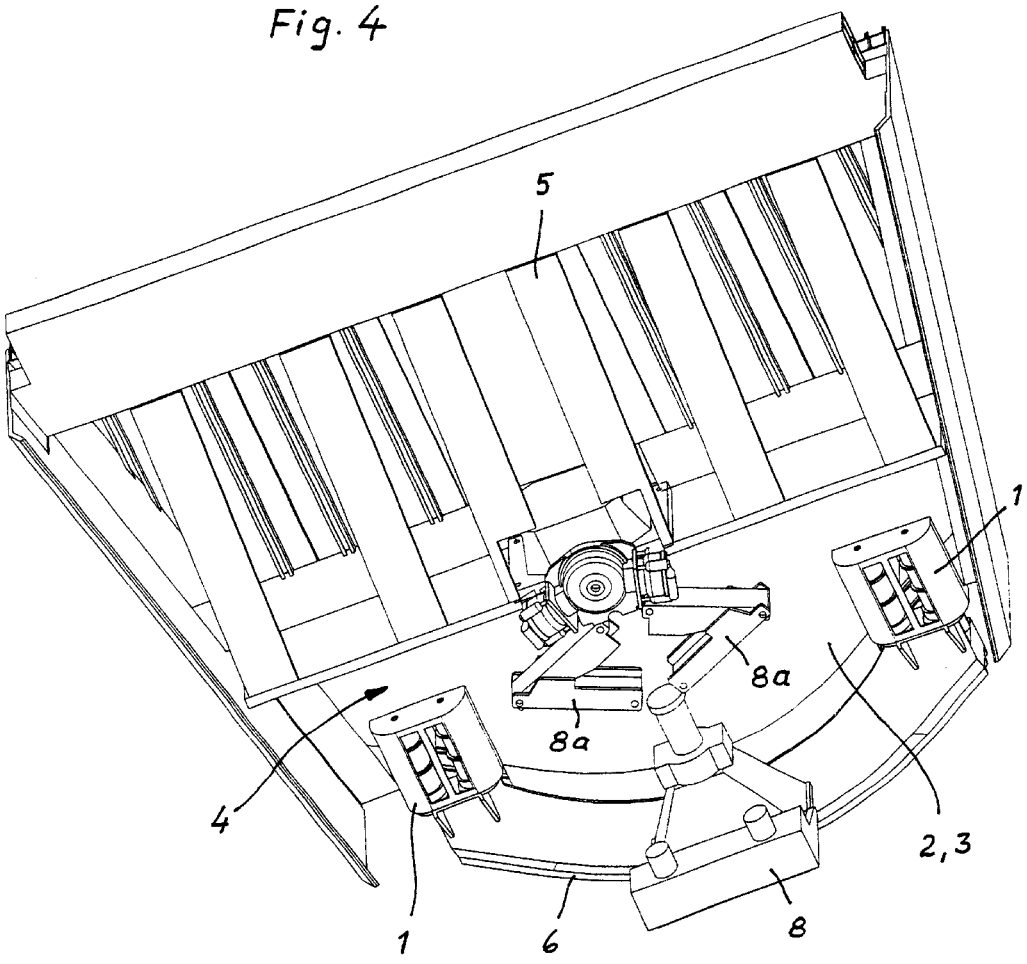

The rail vehicle according to FIGS. 1 and 2 and according to FIGS. 3 and 4 is provided with shock-absorbing units 1 that are part of an "anti-climber" here, which anti-climber also comprises a bumper 6 moulded on the front side. The shape of this bumper 6 prevents the vehicle from climbing up, especially if it runs into a vehicle of the same type. The shock-absorbing units 1, which can be designed according to the publication WO 98/38 438, for example, and which at least comprise a deformable portion of a thick-walled plastic tube, are connected to the bumper 6 on the one hand, and, on the other hand, are supported against a sandwich component 2 in the longitudinal direction of the vehicle.

The sandwich component 2—comprised mainly of aluminum and a metallic foam—forms, as a load-bearing structural element, a sub-region of the floor 3 of the driver's cabin 4. In the exemplary embodiments, the overall length of the sandwich component 2 is limited to the region of the floor 3 that lies underneath a driver's stand (not shown) located in the driver's cabin 4. The sandwich component 2 is connected in removeable fashion only to central terminal load-bearing elements 5 of the vehicle structure.

Figure 5:
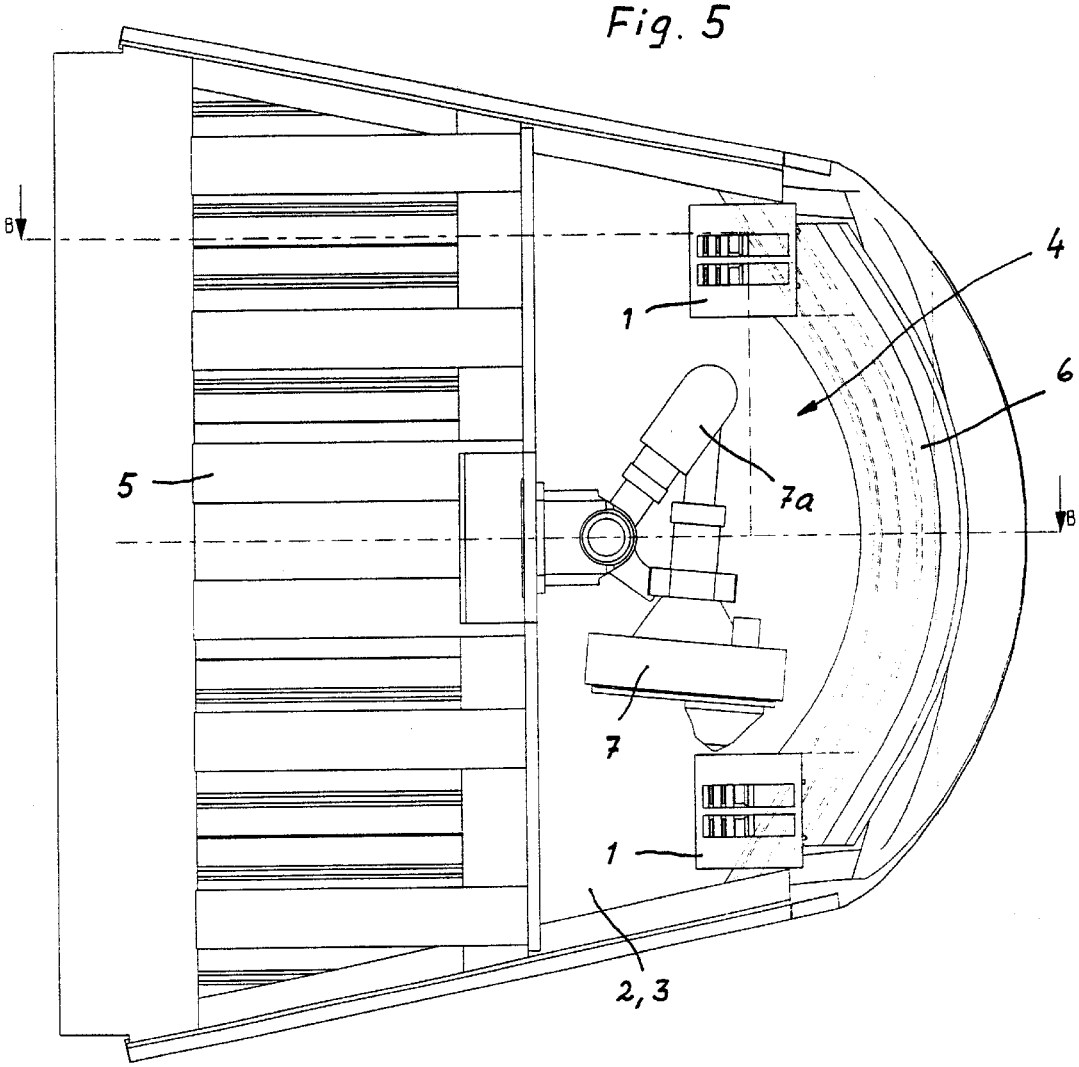
FIGS. 5 through 8 are supplementary views and sectional views of FIGS. 1 and 2.
Figure 6:
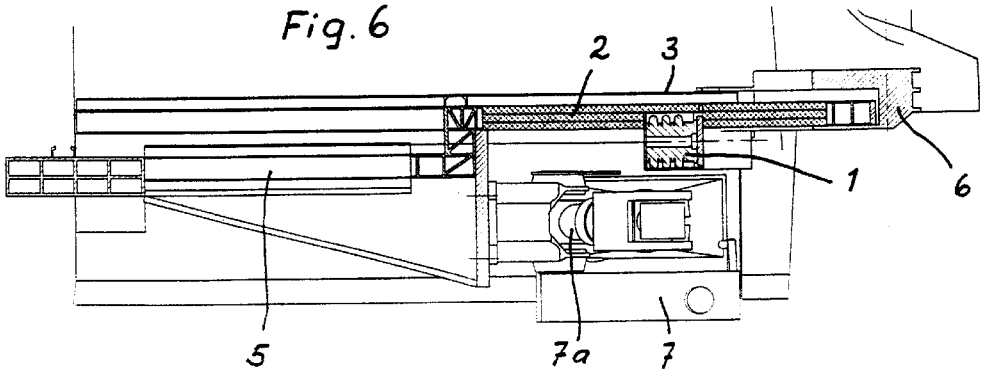
Figure 7:
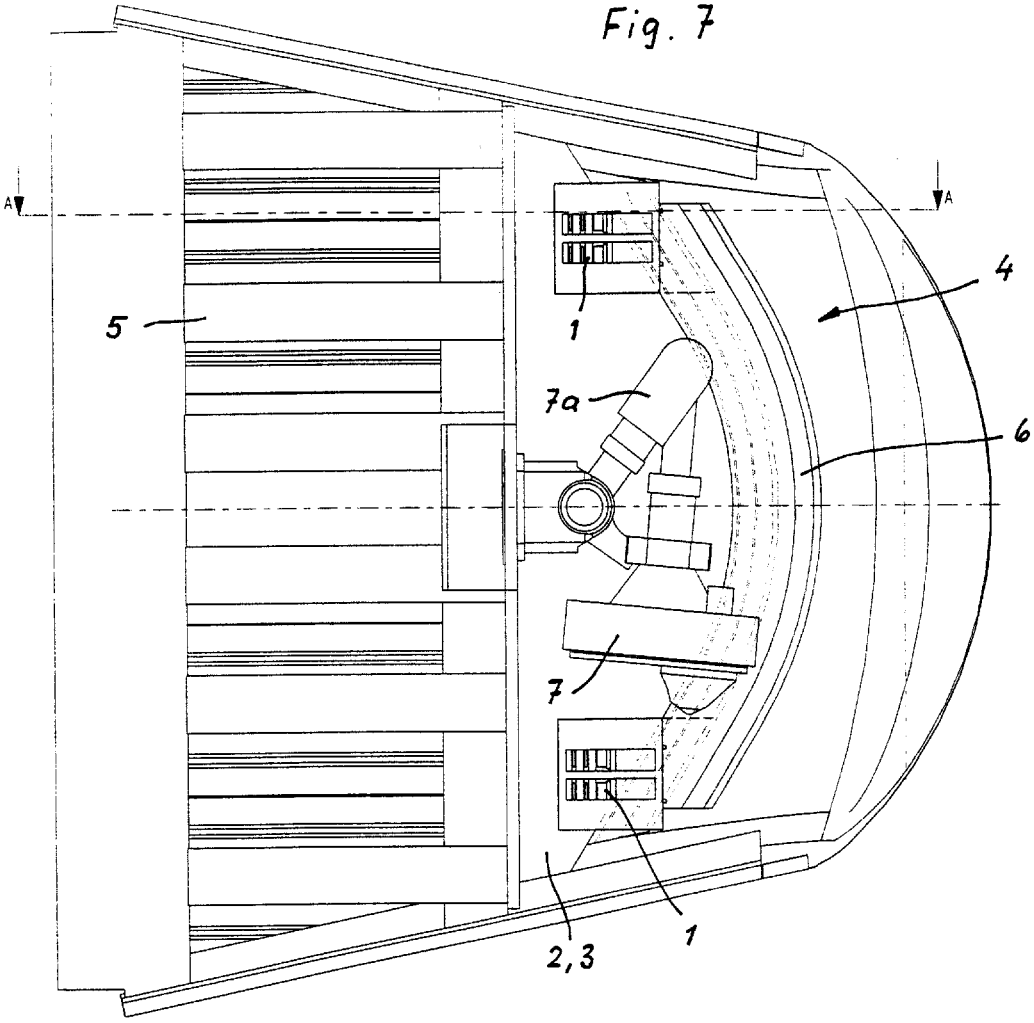
Figure 8:
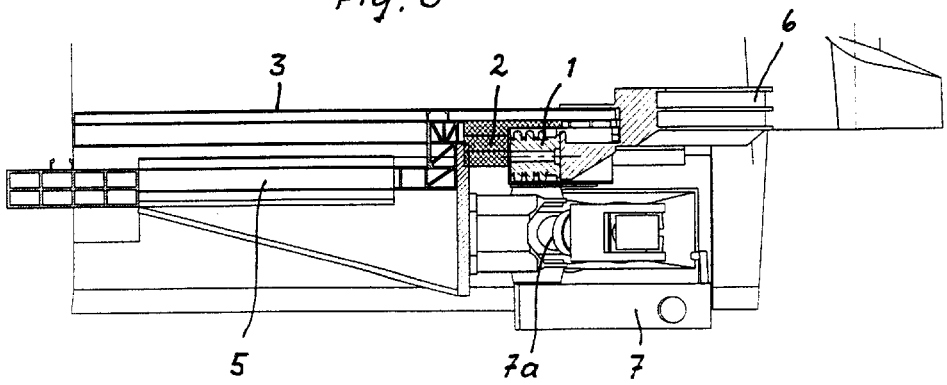
Figure 9:
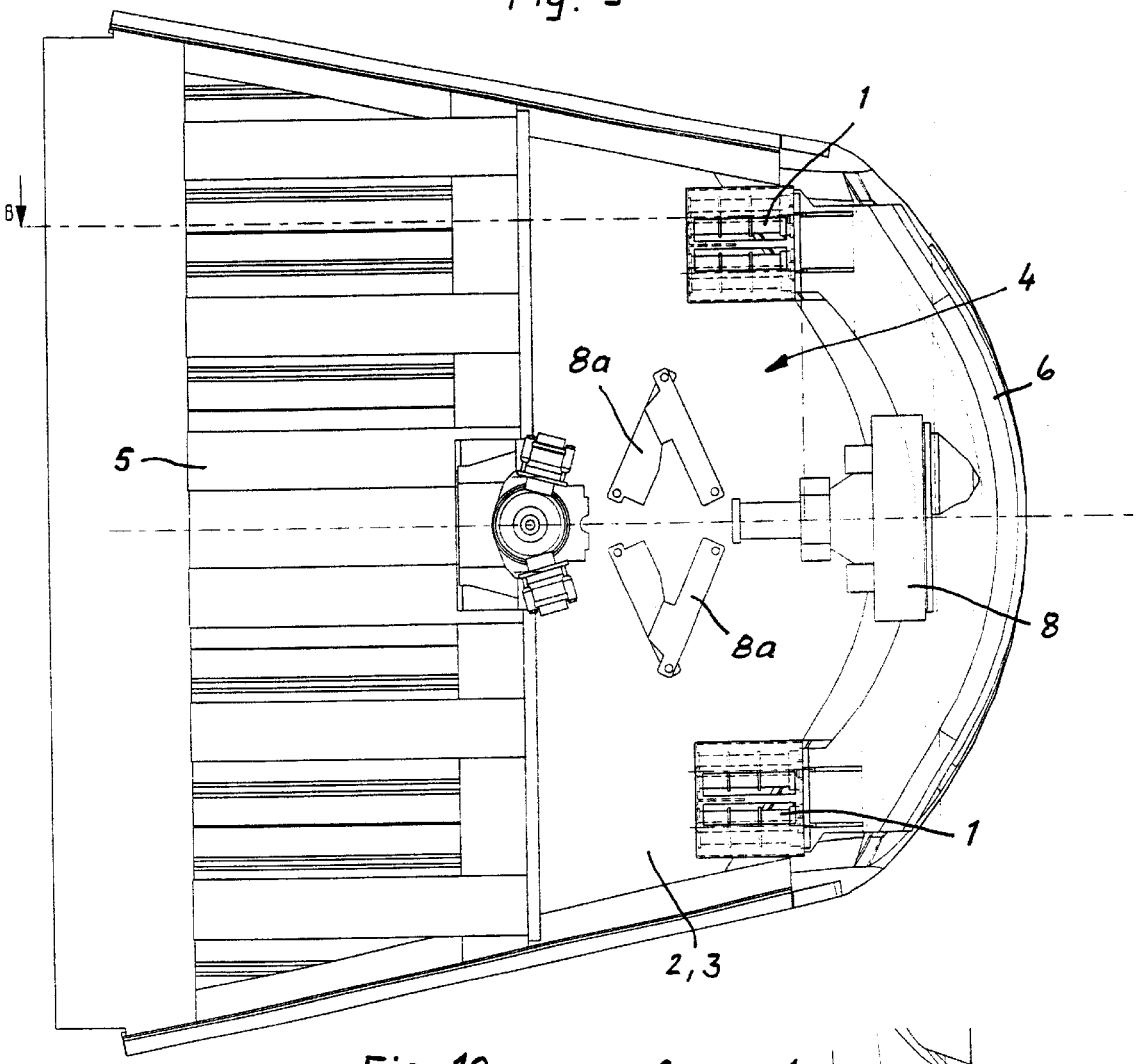
FIGS. 9 and 10 supplement FIGS. 3 and 4 accordingly.
Figure 10:
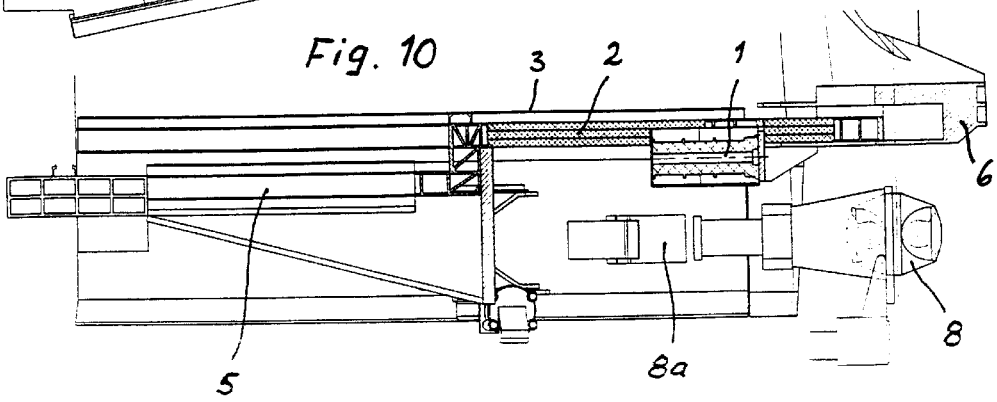

The rail vehicle according to the invention advantageously has a 3-staged collapsible zone having a defined behavior if impact occurs. Said defined behavior is as follows:

a) Softer impacts that occur at speeds of up to approximately 8 km/h are absorbed by the shock-absorbing units 1 alone—which are shown in the non-deformed state in FIGS. 9 and 10 in particular—which shock-absorbing units deform in a plastic manner (refer to FIGS. 5 and 6). The shock-absorbing units 1 are then simply replaced with new components. The vehicle itself is undamaged.

b) At speeds of up to 17 km/h, the shock-absorbing units 1 and, in addition, the sandwich component 2 (refer to FIGS. 7 and 8) deform, which said sandwich component serves to absorb shock in addition to its load-bearing function. In this case as well, the slight damage to the vehicle can be eliminated by means of minor repair work using components that are easy to replace.

c) At speeds of up to approximately 32 km/h, a more serious accident can be assumed in which, in addition to the shock-absorbing units 1 and the sandwich component 2, only the central terminal load-bearing elements 5 of the vehicle structure are deformed, however. The external longitudinal load-bearing elements and the passenger compartment itself are undamaged, however, even in cases of high energy absorption of this nature.

As one can see in FIGS. 1 and 2 and FIGS. 3 and 4, the central buffer coupling 7 and 8 of the respective vehicle is situated, in the non-coupled position, entirely behind the front of the vehicle. When two vehicles are coupled, the 3-staged collapsible zone described above is expanded by means of a spring and damping device, which is usually contained in the coupling arm 7*a* of the central buffer coupling 7 or is installed behind the scissors-type elements 8*a* of the central buffer coupling 8. The respective rail vehicle then has a 4-staged crash behavior overall upon impact.

| List of Reference Numerals | |
|---|---|
| 1 | Shock-absorbing unit |
| 2 | Sandwich component comprised of aluminum and metallic foam |
| 3 | Floor |
| 4 | Driver's cabin |
| 5 | Central terminal load-bearing element |
| 6 | Bumper |
| 7 | Central buffer coupling |
| 7a | Hinged coupling arm |
| 8 | Central buffer coupling |
| 8a | Scissors-like element |

What is claimed is:

1. A rail vehicle for passenger transportation, especially for local traffic, having shock-absorbing units (1) on at least one ends, wherein the shock-absorbing units (1) are supported in the longitudinal direction of the vehicle against a deformable sandwich component (2) containing metallic foam, wherein said sandwich component forms a sub-region of a floor (3) of a driver's cabin as a load-bearing structural element.

2. The rail vehicle according to claim 1, wherein an overall length of the sandwich component (2) is limited to a region of the floor (3) that lies underneath a driver's stand located in the driver's cabin.

3. The rail vehicle according to claim 1, wherein the sandwich component (2) is removeably connected to the vehicle structure in the sense of simple replacement after energy absorption.

4. The rail vehicle according to claim 3, wherein the sandwich component (2) is connected only to terminal load-bearing elements (5) of the vehicle structure, whereby external longitudinal load-bearing elements and, therefore, a passenger compartment itself, are not involved in energy absorption.

* * * * *